US008190077B2

(12) United States Patent
Naruse et al.

(10) Patent No.: US 8,190,077 B2
(45) Date of Patent: May 29, 2012

(54) CLEANING DEVICE AND IMAGE FORMING APPARATUS

(75) Inventors: Osamu Naruse, Yokohama (JP); Hidetoshi Yano, Yokohama (JP); Kenji Sugiura, Yokohama (JP); Naomi Sugimoto, Kawasaki (JP); Hiroki Nakamatsu, Fujisawa (JP)

(73) Assignee: Ricoh Company, Ltd., Tokyo (JP)

( * ) Notice: Subject to any disclaimer, the term of this patent is extended or adjusted under 35 U.S.C. 154(b) by 415 days.

(21) Appl. No.: 12/484,294

(22) Filed: Jun. 15, 2009

(65) Prior Publication Data

US 2009/0311004 A1 Dec. 17, 2009

(30) Foreign Application Priority Data

Jun. 16, 2008 (JP) ..... 2008-156750

(51) Int. Cl.
*G03G 21/00* (2006.01)

(52) U.S. Cl. ..... 399/349; 399/353; 399/354

(58) Field of Classification Search ..... 399/101, 399/349, 350, 353, 354
See application file for complete search history.

(56) References Cited

U.S. PATENT DOCUMENTS

| | | | |
|---|---|---|---|
| 5,260,754 | A | 11/1993 | Yano et al. |
| 5,386,274 | A | 1/1995 | Sanpe et al. |
| 5,526,100 | A | 6/1996 | Misago et al. |
| 5,592,267 | A | 1/1997 | Misago et al. |
| 5,606,408 | A | 2/1997 | Yano et al. |
| 5,619,316 | A | 4/1997 | Shoji et al. |
| 5,740,494 | A | 4/1998 | Shoji et al. |
| 5,765,087 | A | 6/1998 | Yano et al. |
| 5,999,773 | A | 12/1999 | Yasutomi et al. |
| 6,799,012 | B2 | 9/2004 | Shakuto et al. |
| 6,987,944 | B2 | 1/2006 | Shakuto et al. |
| 7,062,212 | B2 | 6/2006 | Naruse et al. |
| 7,103,301 | B2 | 9/2006 | Watanabe et al. |
| 7,123,872 | B2 | 10/2006 | Shakuto et al. |
| 7,184,699 | B2 | 2/2007 | Naruse et al. |
| 7,369,807 | B2 | 5/2008 | Naruse et al. |
| 7,415,238 | B2 | 8/2008 | Watanabe et al. |
| 2005/0058474 | A1 | 3/2005 | Watanabe et al. |
| 2006/0285898 | A1 | 12/2006 | Watanabe et al. |
| 2007/0003337 | A1 | 1/2007 | Shakuto et al. |
| 2008/0170878 | A1 * | 7/2008 | Yamashita et al. ..... 399/99 |

FOREIGN PATENT DOCUMENTS

| | | | |
|---|---|---|---|
| JP | 64-36867 | | 3/1989 |
| JP | 05289593 | A * | 11/1993 |
| JP | 3524423 | | 2/2004 |
| JP | 2006267311 | A * | 10/2006 |
| JP | 3900283 | | 1/2007 |
| JP | 2007-121568 | | 5/2007 |

OTHER PUBLICATIONS

Misago et al. (JP 05-289593 A), Machine Translation.*

* cited by examiner

*Primary Examiner* — David Gray
*Assistant Examiner* — Erika J Villaluna
(74) *Attorney, Agent, or Firm* — Dickstein Shapiro LLP

(57) ABSTRACT

A cleaning device 20 for removing a toner remaining on an image bearing member 5A after transfer, including: a polarity control member 23 configured to unify polarities of the remaining toner on the image bearing member 5A, a cleaning member 25 configured to remove the remaining toner having a polarity unified by the polarity control member 23, a collecting member 24 configured to collect the remaining toner transferred to the cleaning member 25, a blade 26 configured to remove the remaining toner from the collecting member 24, and a brush roller 21 configured to sweep the remaining toner on the image bearing member 5A and inject charge, disposed upstream of the polarity control member 23 in the traveling direction of the image bearing member 5A.

9 Claims, 4 Drawing Sheets

$$SF-1=\frac{(MXLNG)^2}{AREA}\times\frac{\pi}{4}\times 100$$

CLEANING DEVICE AND IMAGE FORMING APPARATUS

BACKGROUND OF THE INVENTION

1. Field of the Invention

The present invention relates to a cleaning device and an image forming apparatus, more specifically to a cleaning configuration for cleaning a spherical toner such as a toner obtained by a polymerization.

2. Description of the Related Art

As is generally known, in an image forming apparatus such as a copier, printer or a printing machine, a photoconductor as a latent electrostatic image bearing member is charged uniformly in a charging step, and a latent electrostatic image is formed thereon by exposing it to light corresponding to image data.

The latent electrostatic image formed on the photoconductor is visualized by a toner supplied from a developing device, and then the visualized image is transferred by a transferring unit onto a recording medium such as paper or an intermediate transfer member. A transfer onto a recording medium is mainly carried out to form a monochrome image, and a transfer onto an intermediate transfer member is carried out to form a multicolored image such as a full-color image. A multicolored image can be formed in two manners. Firstly, an image of each color is successively transferred onto the intermediate transfer member and the obtained superimposed image is transferred together onto a recording medium. Secondly, when a belt is used as an intermediate transfer member, a recording medium is adsorbed and retained on the belt, and the belt is moved through image forming stations at each of which each specific color is transferred to the recording medium, resulting in a superimposed images. In either mode, the final output of copy is a toner image transferred onto the recording medium.

The image bearing member includes not only the photoconductor but also an intermediate transfer member to which each image formed in each image forming station corresponding to each color is transferred.

When images each having different colors are transferred successively to the intermediate transfer member, the intermediate transfer member is subjected to collective transfer of the images of different colors, followed by cleaning of remaining toner containing a toner not transferred. The purpose of the cleaning is to prevent occurrence of background smear due to the transfer of the remaining toner.

Conventionally, a blade cleaning method is well known for use in the above cleaning treatment.

In the blade cleaning method, a blade is brought into contact with the object to be cleaned, intercepts the remaining toner moving toward the blade, and sweeps the toner from the object to be cleaned.

Separately, in recent years, in accordance with a demand for high resolution and high image quality, a toner produced by a polymerization method has been used, in place of the conventionally used toner produced by a pulverization method, since according to the polymerization method, particle size can be uniformly confined to be within a small range and a particle of high sphericity can be obtained.

The toner produced by a polymerization method is, because of its high sphericity, advantageous in that an efficiency of transfer is improved and an amount of a toner discarded as a non-transferred toner is minimized, and therefore has been frequently used. Next, the reason therefor will be explained in more detail.

In the developing step, the toner is provided to the electrostatic latent image borne on the image bearing member such as a photoconductor, under the condition that the toner is given a development bias.

The forces that act on the surface of the image bearing member when the toner adheres on the image bearing member due to the latent electric potential and the development bias on the image bearing member is mirror force and Van der Waals' force. The mirror force depends largely on the amount of electric charge and the distance.

The pulverized toner obtained by a conventional pulverization method has a concavo-convex surface, whose convex portions are intensively charged by frictional charging. In contrast, since a polymerized toner produced by the polymerization method has a spherical shape or close to a spherical shape, the surface thereof is uniformly charged. Moreover, in the pulverized toner, toner particles are in contact with each other at convex portions, suggesting that much charge is concentrated in a very close region so that mirror force increases. If however the toner has a spherical shape as in a polymerized toner, each toner is in contact with each other at a point, and a charge amount in the close region is small, and the mirror force is weaker than that of the pulverized toner.

Since the most pulverized toner is in contact with each other at the convex portions, Van der Waals' force is very large. In contrast, since the polymerized toner has a spherical shape and contacts with each other at a point, the Van der Waals' force of the polymerized toner is smaller than that of the pulverized toner.

Thus, in terms of contact force, due to its spherical shape, the polymerized toner has small attachment force such as small mirror force, and Van der Waals' force to a photoconductor, so that it reduces an amount of the remaining toner after transfer, reducing consumption of the toner, and thus it is economically advantageous.

However, when cleaning the remaining toner, the polymerized toner, which has a small particle diameter and spherical shape, tends to pass through the gap between the blade and the surface of the image bearing member. Therefore, in order to remove the polymerized toner on the image bearing member, it is required to strongly press the blade to the surface of the image bearing member enough to intercept the toner. However, strongly pressing the image bearing member by the blade accelerates the abrasion of the blade and the image bearing member. Moreover, in order to press the blade to the image bearing member, a torque of the motor for driving the image bearing member has to be large, correspondingly.

As a cleaning method for cleaning a small-sized, peripheral toner without causing damages to the image bearing member, a method using a electrostatic brush roller which attracts a toner by electrostatic force has been considered (see Japanese Patent Application Laid-Open (JP-A) No. 2007-121568, Japanese Utility Model Application Laid-Open (JP-U) No. 64-36867, Japanese Patent (JP-B) Nos. 3524423 and 3900283).

JP-A No. 2007-121568 discloses that two brush rollers are disposed in contact with an image bearing member in a direction of movement of the image bearing member, and bias voltage of different polarities are applied to the two brush rollers so that the remaining toner is collected by unifying the polarity of the remaining toner.

JP-U No. 64-36867 discloses, similar to the JP-A No. 2007-121568, that two brush rollers are disposed each of which has different hair density, so that the two brush roller can play complementary roles in the efficiency of scraping the toner.

JP-B No. 3524423 discloses that a charging unit having a charging roller for applying a bias voltage of the polarity reverse to the remaining toner on an image bearing member such as an intermediate transfer belt and the charging unit is mildly contacted to the image bearing member, before the image bearing member enters a cleaning device in the image forming process section.

JP-B No. 3900283 discloses that in the traveling direction of the image bearing member that bears the remaining toner on the surface thereof, a charging unit using a scraper or the like capable of applying bias voltage of the same polarity as that of the toner is disposed in contact with the image bearing member in the upstream side; and a brush to which a bias voltage of reverse polarity to the charging unit is applied is disposed in contact with the image bearing member in the downstream side in order to scrape the remaining toner and to unify the polarity of the toner. Thereafter, the remaining toner which has not been scraped by the brush and whose polarity is unified is scraped by applying a bias voltage reverse to the polarity of the toner.

BRIEF SUMMARY OF THE INVENTION

In the conventional electrostatic brush cleaning device, in view that the remaining toner after the transfer has electric charge, the toner is adsorbed and removed by the brush to which a bias voltage of polarity reverse to the remaining toner is applied. However, it is noted that the electric charge of the remaining toner can be either positive or negative by discharging. Since the bias voltage applied at a transfer step is positive in general, the negative polarity toner after development is adsorbed and transferred and the toner not transferred passes through to a post-process.

As mentioned above, discharging occurs between the transfer media due to a voltage for transfer, resulting in co-existence of positive and negative polarities of the toner, not either one of the polarities alone. In the above JP-A No. 2007-121568 and JP-B No. 3900283, a bias voltage of positive or negative polarity is applied to the toner by use of a bias voltage applying unit such as a brush.

There has been another method in which the polarity is unified to one side with the use of a polarity control unit and a voltage reverse to the unified polarity is applied to a cleaning unit to adsorb the toner. The polarity control units are clarified into those which change the polarity without contacting with the toner and those which change the polarity by contacting with the toner.

The non-contact type method is a method in which ions are attached to the outer surface of the toner by an ionic irradiation such as corona discharge. This method has a drawback that high voltage discharge generates not only ions but also ozone which is harmful for a human body and causes environmental pollutions.

In the contact method, as described in the JP-B No. 3524423, the electric charge is controlled by the action of frictional charge, charge injection, or the like, without causing discharge. Specifically, polarity change is carried out by contacting the toner with a conductive brush, a conductive blade, or the like.

However, in the case of using a brush, the toner tends to adhere to the brush and partially blocks the discharging onto the surface to be biased to unify the polarity, which makes the polarity uncontrollable with time. In the case of using a blade, the contact pressure for contacting the blade with the image bearing member causes abrasive degradation in both the image bearing member and blade, which method is therefore problematic in durability.

The cleaning of an intermediate transfer member has some problems different from the cleaning of a photoconductor. Firstly, since the intermediate transfer member is in contact with paper, paper dusts generated from paper is nipped with the blade. Where the paper dusts are present, a toner cannot be in contact with the blade, and pass through the blade, which means that the polarity control is impossible. The intermediate transfer member is produced by forming a resin or an elastic body into a belt. If a heavy load is given to the blade, the motor for driving the belt has to be large in size, but the motion of the belt cannot be smooth, and the traveling speed of the belt varies in each of the image forming units, causing color drift due to the drift of the transfer position.

In the method disclosed in JP-U No. 64-36867, which does not use pre-cleaning charging, only the hair density of the brush is changed to change the way to catch the remaining toner, and thus, the collecting of all the toner particles having the above mentioned charge polarity.

The object of the present invention is to provide a cleaning device and an image forming apparatus which solve the conventional drawbacks, especially drawbacks in the cleaning device for cleaning a toner having a small size and is spherical; and which is capable of enhancing a efficiency of the cleaning by a cleaning member by performing a certain polarity control to the remaining toner, even when foreign matters other than the toner are present and a large quantity of the remaining toner that is not the object of transfer is present.

The present invention was accomplished based on the above-described finding, and the means for solving the problems are as follows.

<1> A cleaning device for removing a toner remaining on an image bearing member after transfer, including:

a polarity control member configured to unify polarities of the remaining toner on the image bearing member, a cleaning member configured to remove the remaining toner having a polarity unified by the polarity control member, a collecting member configured to collect the remaining toner transferred to the cleaning member, a blade configured to remove the remaining toner from the collecting member, and a brush roller configured to sweep the remaining toner on the image bearing member and inject charge, disposed upstream of the polarity control member in the traveling direction of the image bearing member.

<2> The cleaning device according to <1>, wherein the brush roller has conductivity and is connected to a bias voltage applying unit.

<3> The cleaning device according to <2>, wherein the brush roller has a brush containing conductive strings, and the conductive strings are exposed from a surface of the brush to be in contact with the toner.

<4> The cleaning device according to <1>, wherein the brush roller and the polarity control member are applied with the same polarity of voltage, and the brush roller is applied with an equal or lower value of voltage compared to the applied voltage of the polarity control member.

<5> The cleaning device according to <1>, wherein the cleaning member is a brush roller having a reverse polarity of voltage to a polarity of voltage applied to the brush roller disposed upstream of the polarity control member.

<6> The cleaning device according to <1>, wherein stiffness of the brush of the brush roller used in the cleaning member is higher than the stiffness of the brush of the brush roller disposed at upstream of the polarity control member.

<7> The cleaning device according to any one of <1> and <6>, wherein a hair density of the brush roller disposed upstream of the polarity control member is higher than that of the brush roller used as the cleaning member.

<8> The cleaning device according to <1>, wherein the remaining toner on the image bearing member has a shape factor SF-1 of 100 to 150 and a toner average particle diameter of 6 μm or less.

<9> An image forming apparatus containing the cleaning device as described in any one of <1> to <8>.

<10> The image forming apparatus according to <9>, wherein the cleaning device is configured to clean an intermediate transfer member.

According to the present invention, since a brush roller is disposed upstream of the polarity control member in the traveling direction of the image bearing member, foreign matters other than the remaining toner, such as paper, can be swept by the brush. In addition, by using the action of sweeping, at least part of a large amount of the remaining toner such as a patch image which is formed on the image bearing member and is not transferred can be removed.

Thus, the entry of the remaining toner to the polarity control member is prevented, so that the contact between the polarity control member and the remaining toner on the image bearing member can be protected from foreign matters and an accumulated toner, to thereby ensure an excellent polarity control. As a result, the polarity of the remaining toner can be set such that the remaining toner is easily removed by the cleaning member.

DETAILED DESCRIPTION OF THE INVENTION

Hereinafter, the best mode for practicing the present invention will be explained with reference to drawings.

Figure 1:
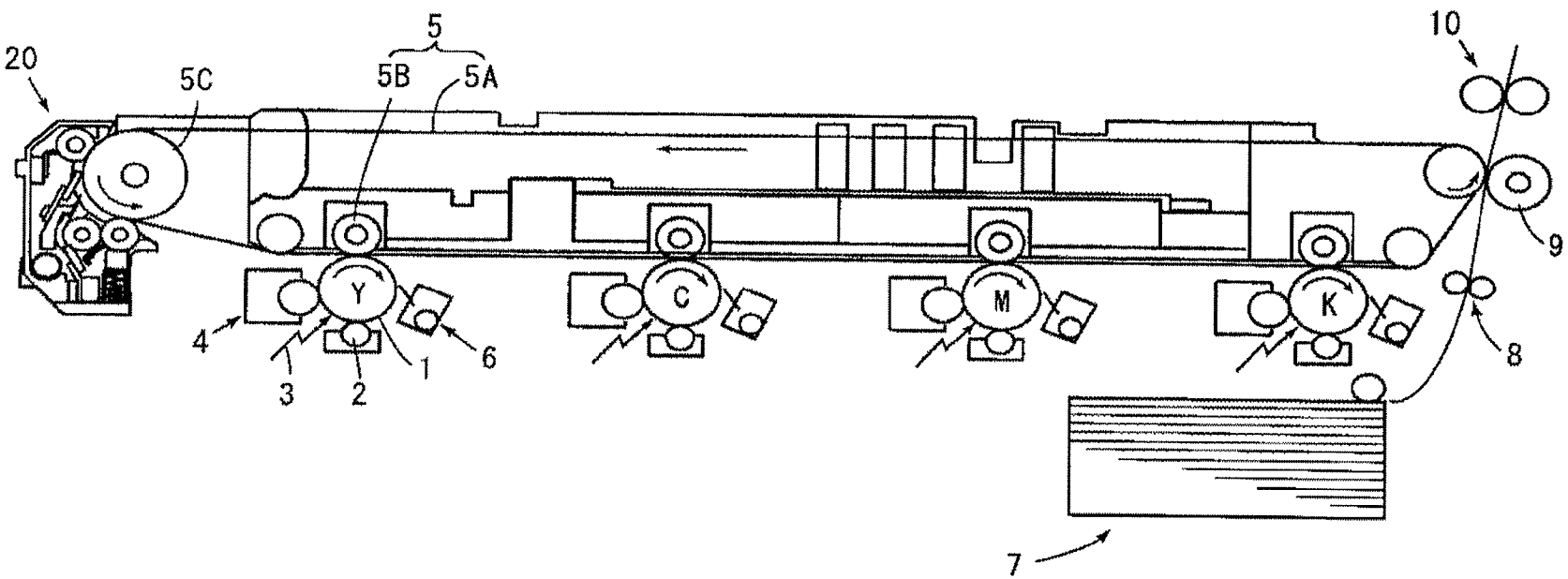
FIG. 1 is a schematic diagram for explaining an example of an image forming apparatus equipped with the cleaning device according to the present invention.

FIG. 1 shows an example of an image forming apparatus using the cleaning device of the present invention. The image forming apparatus shown in FIG. 1 is a tandem image forming apparatus using a belt as an intermediate transfer member which is one of image bearing members, and along the tensional direction of the belt, image forming units (in FIG. 1, each unit is equipped with a photoconductor drum having each of Y, C, M and K indicating a color to be used) are placed tandem.

Since the image forming units have the same configuration, only the image forming unit indicated by reference character Y will be explained.

Each image forming unit is made as one unit in which a photoconductor drum 1, another one aspect of the image bearing member, is mounted rotatably.

At positions surrounding the photoconductor drum 1, a charging device 2, an exposing device (in FIG. 1, numeral 3 is given to light for writing for convenience), a developing device 4, a transfer device 5, and a cleaning device 6 are disposed for an image forming process. Of these devices, the charging device 2, the developing device 4 and the cleaning device 6 are disposed in one unit, forming a process cartridge.

The transfer device 5 includes an intermediate transfer belt 5A on whose extended surface disposed each image forming units are disposed, and a transfer roller 5B facing each photoconductor drum and pressing the intermediate transfer belt 5A on the photoconductor drum.

At one portion of the intermediate transfer belt 5A, a secondary transfer device 9 is disposed by which superimposed transfer images are transferred together onto a recording medium such as paper which is drawn out from a paper feeding device 7 and is conveyed to the secondary transfer device 9, with the resist timing being set by a resist roller 8. At a position of the recording medium conveyed from the secondary transfer position by the secondary transfer device 9, a fixing device 10 is disposed for fixing the toner image on the recording medium by a heat roller fixing method using a heating roller and a compressing roller.

The photoconductor drum 1 is made of a conductive base member such as aluminum on the surface of which a thin layer of, for example, an organic semiconductor is formed. As the charging device 2, a bias roller capable of closely approaching to or contacting with the surface of the photoconductor drum 1.

The developing device 4 uses a polymerized toner. The polymerized toner preferably has a shape factor SF-1 (which indicates a degree of roundness of the spherical matter) of 100 to 150, and has a particle diameter of 6 μm of less.

The shape factor SF-1 will be explained as follows.

Figure 2:
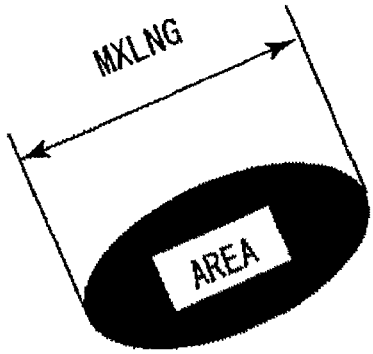
FIG. 2 is a schematic diagram for explaining a shape factor of the toner used in a development device used in the image forming apparatus as shown in FIG. 1.

As mentioned above, the shape factor SF-1 of a toner is a numeral value corresponding to the degree of roundness of a spherical matter, and is represented by a value obtained by dividing the square of the maximal length MXLNG of an elliptical figure obtained by projecting the spherical matter on a two-dimensional plane with the area of the figure AREA, and multiplying the resultant value by 100 $\pi/4$, as shown in FIG. 2.

In other words, the shape factor SF-1 is defined by the following equation.

$$SF\text{-}1=[(MXLNG)^2/AREA]\times(100\pi/4)$$

If the value of SF-1 is 100, the shape of the toner is complete sphere. The bigger the value of SF-1, the more irregular the shape of the toner is. Generally, when the toner shape is close to a sphere, a toner particle and a toner particle, or a toner and an image bearing member contact with each other in a point-contact state, which weakens the adsorbability between the toner particles, enhancing the fluidity, and which also weakens the adsorbability between the toner and the image bearing member, enhancing the transfer ratio.

The toner for use in the present embodiment is obtained as follows: a toner composition containing a colorant and a binder resin containing a modified polyester-based resin capable of forming urea bonds is dissolved or dispersed in an organic solvent, followed by a particle formation and polyaddition reaction in an aqueous solvent. The solvent of the dispersion is removed, and the resultant product is washed and dried, whereby the toner is obtained.

A spherical toner may be obtained by, in addition to the above mentioned production method, a known polymerization method such as an emulsion polymerization method, a suspension polymerization method, and a dispersion polymerization method. Alternatively, a spherical toner may be obtained by thermal-melting a toner obtained by a conventional pulverization method.

In the image forming apparatus having the above mentioned structure, the charging device 2 charges uniformly the surface of the photoconductor drum 1, and by exposing the surface to writing light corresponding to image data using an exposing device 3, a latent electrostatic image is formed on the photoconductor drum 1 The latent electrostatic image is developed to a visual image by a toner supplied by a developing device 4. In the present embodiment, an inversion development is carried out using a negatively charged toner.

The toner image visualized on the photoconductor drum 1 is transferred onto an intermediate transfer belt 5A which travels at a speed equal to that of the photoconductor drum 1 by the transfer bias action of a transfer roller 5B in a transfer device 5.

The toner images formed in the image forming units are successively transferred onto the intermediate transfer belt 5A to form a superimposed image. The superimposed image is transferred onto the recording medium fed from the paper feeding device 8 using a secondary transfer device 9, and the recording medium is conveyed to the fixing device 10 where the toner image is fixed.

The intermediate transfer belt 5A having passed through the secondary transfer device is subjected to cleaning of foreign matters including the remaining toner by means of a cleaning device (represented by a numeral 20, for convenience).

Figure 3:
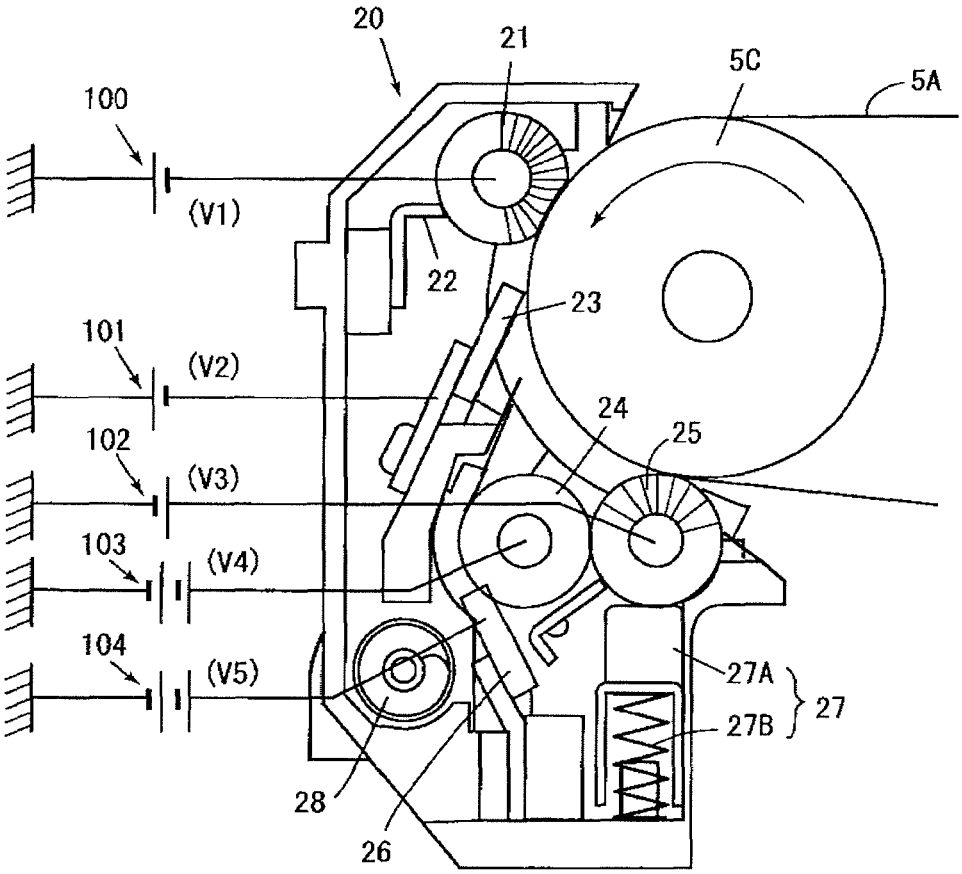
FIG. 3 is a schematic diagram for explaining an example of a principal structural part of the cleaning device of the present invention.

FIG. 3 is a diagram illustrating an example of a structure of the cleaning device 20. The cleaning device 20 includes: a brush roller 21 facing the peripheral surface of one of the rollers (represented by a numeral 5C, for convenience) around which the intermediate transfer belt 5A is wound; a polarity control member 23 which controls polarity to make the polarity of the toner uniform; and a cleaning member which is a brush roller, are disposed along the traveling direction of the intermediate transfer belt 5A. Hereinafter, the brush roller 21 will be referred to as a primary brush roller 21, and the brush roller to be used as the cleaning member will be referred to as a secondary brush roller 25.

The configuration shown by FIG. 3 is characterized by that the primary brush roller 21 is disposed upstream of the polarity control member 23 for controlling polarity in the traveling direction (the direction indicated by the arrow in FIG. 3) of the intermediate transfer belt 5A, one of the image bearing members.

In FIG. 3, a numeral 22 is a flicker member whose tip is in contact with the primary brush roller 21, a numeral 24 is a toner collecting roller which collects the toner by contacting with the secondary brush roller 25, a numeral 26 is a collecting blade whose tip is in contact with the toner collecting roller, a numeral 27 is a lubricant providing device to provide a lubricant to enhance a transfer efficiency for a polymerized toner, and a numeral 28 is a conveying screw for conveying the collected toner to the developing device or a disposal tank.

Next, the intermediate transfer belt 5A and the members relating to the cleaning thereof will be explained.

The intermediate transfer belt 5A, one of image bearing members, is obtained by adding a suitable amount of a conductive material such as a carbon black to a synthetic resin such as polyimide, polycarbonate, polyester, and polypropylene or various rubbers, and is set to have a volume resistivity of $10^4\Omega\cdot$cm to $10^9\Omega\cdot$cm.

The intermediate transfer belt 5A having the elasticity consists of a conductive elastic layer as a principal base material and a conductive protective layer. A material for the conductive elastic layer may be silicone rubber, NBR, CR, EPDM, or urethane rubber. A material for the conductive protective layer is not particularly limited, provided that it meets the following requirements: reduction of coefficient of friction, stability of electric performance to environment, and improvement of cleanability of the remaining toner due to reduction of surface roughness. The material for the conductive protective layer is, for example, a paint obtained by dissolving or dispersing a fluorocarbon resin-based polymer such as polytetrafluoroethylene (PTFE), a copolymer (PFA) of tetrafluoroethylene and perfluoroalkylvinylether, and PVDF into an emulsion of an alcohol-soluble nylon, silicone, silane coupler or urethane resin emulsion, or an organic solvent.

The protective layer can be formed by applying the paint through a dip coating, spray coating, electrostatic coating, or roll coating. In addition, by performing a surface treatment or abrasion treatment to the protective layer, releasability, conductivity, abrasion resistance, surface cleanability and the like can be improved.

The primary brush roller 21 has a function of sweeping paper dusts which are foreign matters other than the toner existing on the intermediate transfer belt 5A; a function of sweeping part of a large amount of the accumulated toner; and a function of providing the toner with electric charge in the same manner as in the polarity control member 22. The reason why the primary brush roller should have these functions is described as follows.

On the surface of the intermediate transfer belt 5A, in addition to the remaining toner, paper dusts may be attached which are transferred from a recording paper as a recording medium when the brush roller is in contact with the recording paper. The paper dusts are in the form of fibers each having a length of several ten microns to several hundred microns, which often passes through the gap between the tip of the blade and the surface of the intermediate transfer belt 5A in the cleaning using the blade. The primary brush roller ensures the removal of such paper dusts by sweeping them.

There is a case in which, aside from the toner image, a patch image as a test pattern for each color may be formed on the intermediate transfer belt 5A, aiming at image density control. Unlike a normal image formation, the patch image is not transferred, and is removed from the intermediate transfer belt 5A after detecting the density of the patch image. Thus, when the intermediate transfer belt 5A reaches the cleaning device 20, the amount of the toner to be intercepted by the polarity control member 22 is great and the amount of the toner contacting to the blade used as a polarity control member 22 is great, so that uniform charge injection is hard to carry out. In view of this, at least part of the accumulated toner should be swept by the primary brush roller 21 to reduce the amount of the toner in contact with the polarity control member 22, improving the scraping efficiency. By applying a biased voltage having the same polarity as in the polarity control member 22 to the toner remaining unscraped, the polarity of the remaining toner can be effectively uniformed. Accordingly, a power source 100 for applying a bias voltage of the same polarity as the polarity control member 22, which will be mentioned later, is connected to the primary brush roller 21.

Examples of the material for the brush include nylon, polyester, acryl, vinylon, and aramid. A conductive string is configured to expose from the surface and be in contact with the toner to easily inject the electric charge thereto. A resistivity of the brush is preferably $10^4\Omega$ to $10^9\Omega$. A small resistivity of the brush facilitates charge injection to a toner. In such a case, the conductive strings are exposed from the brush surface and bought into contact with the toner so that charge injection to the toner can be performed without lowering the voltage to the discharge voltage.

Such a configuration of the primary brush roller 21, which facilitates charge injection, can reduce the burden of polarity control by the polarity control member 23. In such a configuration, since the polarity control member 23 can enhance the contact with the remaining toner when controlling polarity, it is not necessary to strongly press the polarity control member 23 against the intermediate transfer belt 5A. Thus, abrasion deterioration in the polarity control member 23 and in the intermediate transfer belt 5A can be reduced.

The polarity control member 22 is used to unify the polarity of the toner that remains after the transfer step, and is connected to a power source 101 for applying a bias voltage whose polarity is the same as that of the primary brush roller 21. The value of the bias voltage applied from the power source 101 is set equal to or lower than the value of the bias voltage at the polarity control member 23. Thus, charge injection to the remaining toner can be performed without occurring discharge.

The reason for using the polarity control member 22 is described as follows.

Since, after the transfer, toner particles with positive polarity are mixed with toner particles with negative polarity, it is necessary for the polarity of toner particles to be converted and unified through either charge injection or discharge depending on the polarity of the bias voltage provided by the polarity control member 22.

As another important function, the polarity control member 22 has a function of controlling the toner amount (i.e., the amount of the toner which is bought in contact with the brush roller) entering the secondary brush roller 25. If the toner amount entering the secondary brush roller 25 is large, the toner cannot fully be removed by the brush. Unlike a roller, a brush is not in contact with the image bearing member at its whole surface, so that only a toner brought into contact with the fiber of the brush is removed and attached to the brush due to an electrostatic attracting force, and so the image bearing member is cleaned. As mentioned earlier, a blade is less effective for cleaning a spherical, small toner, and thus a pressing force of the brush onto the image bearing member has to be 5 times or more compared with conventional pressing force for the stable cleaning over a long period of time. By the application of such a great force, both the image bearing member and the blade were impaired, degrading the durability. However, it not necessary to apply such a great force to reduce the toner amount on the image bearing member if it is sufficient to perform the final cleaning only by the brush without perfect cleaning. The toner amount to be removed by the blade has to be limited to somewhere within the amount which the cleaning by the brush can follow up. Functions required to the blade include a function of charge injection to the toner and a function of shaking off the remaining toner. The material for the blade, which does not deteriorate the surface of the image bearing member and is in contact with the whole surface thereof, is preferably an elastic material such as polyurethane, silicone, and fluorine-based rubber. In view of the required durability and capability of withstanding an environmental variation, it is preferable for the blade to have the performance as follows: hardness HS (JISA) of 65 degrees to 80 degrees, elastic modulus of 15% to 60% at 23° C., Yang's modulus of 50 kg/cm$^2$ to 200 kg/cm$^2$, 100% modulus of 60 kgf/cm$^2$ to 200 kgf/cm$^2$.

As for the charge injection performance, in order to enhance the injection efficiency without causing discharge, it is preferable to use the blade having a volume resistivity of $10^3\Omega\cdot$cm to $10^8\Omega\cdot$cm. This region of the resistivity can be obtained by a conductive substance and carbon, ion, or a hybrid of the both. An applied voltage to the blade is preferably −500 V to −1,200 V. The voltage lower than −1,200 V results in poor efficiency of charge injection, and the voltage higher than −500 V causes the surface potential of the image bearing member to be excessively negative so that the adhesive power of the image bearing member with toner becomes stronger.

As the secondary brush roller 25, it is preferable to use a conductive brush produced by mixing an acryl, PET or polyester with a conductive material.

The conductive material is not dispersed onto the surface of the brush. It is necessary to take a core-in-sheath structure in which the conductive material is placed inside thereof and is not exposed on the surface. If the conductive material is exposed on the surface, the electric potential (represented by the reference character Vb in FIG. 5) cannot be maintained by the charge injection to the remaining toner.

The resistivity of the brush is preferably $10^4\Omega$ to $10^9\Omega$. If the resistivity is lower than $10^4\Omega$, the charge injection to toner is easy. If the resistivity is higher than $10^9\Omega$, the electric field strength is weak, so that impression of high voltage is needed to secure electric field for attracting toner.

Moreover, in order to increase probability of contacting with the toner, a brush implantation density is also an important factor. The brush implantation density is preferably 70,000 hairs/inch$^2$ or more, more preferably 100,000 hairs/inch$^2$ or more, which is considered to be higher than the brush implantation density in the primary brush roller 21.

While the paper dust removed by the primary brush roller is from more than ten micrometers to several ten micrometers in size, the size of the remaining toner is 2 μm to 7 μm. Accordingly, removal efficiency by each brush roller can be increased by setting the brush density correspondingly to the above size.

In order to increase contact probability, the brush is preferably rotated in the counter direction to the image bearing member with a linear velocity ratio of 0.7 or more. As another important factor, the inclination of the brush is considered. In general, a brush is said to be in an upright position. But if the brush is in an upright position, the tip portion thereof where a conductive material is exposed can easily be brought into contact with the toner. In view of this, it is preferable for the brush to be inclined, through inclination or brushing treatment of the brush, toward a direction in which the image bearing member rotates, in order to avoid the direct contact between the toner and the conductive material.

A power source 102 is connected to the secondary brush roller 25 so as to apply thereto a bias voltage under which the remaining toner, polarity of which has been unified by the polarity control member 22, can electrostatically adsorb onto the brush. This application of the bias voltage also makes it easier to adsorb and collect the remaining toner whose polarity has been unified by the polarity control member 23 with electrostatic force having a polarity reverse to the polarity of the toner.

A toner collecting roller 24 is a member for collecting the remaining toner swept from the surface of the intermediate transfer belt 5A using the secondary brush roller 25. The toner collecting roller 24 is connected to a power source 103 so as to apply thereto a voltage higher than the bias voltage applied to the secondary brush roller 25 in order to prevent lowering of the surface potential of the rollers due to the contact between the toner collecting roller and the brush of the secondary brush roller 25.

The toner collecting roller 24 is an insulating roller formed integrally by inserting a metallic material as a cored bar into a resin material. It is also possible to form the toner collecting roller 24 as an insulating collecting roller whose cored bar is covered with any of PET, PVDF, PFA, or copolymer nylon formed as a tube.

In another method of forming the toner collecting roller, the aluminum core is subjected to alumite treatment or fluorocarbon resin hardened alumite treatment to obtain an insulating metal surface. By coating the surface of the metallic material with an inorganic material such as ceramic and an organic material such as PTFE, polyimide and polycarbonate, an insulating collecting roller can easily be obtained. The reason for insulating the metal surface is described later with reference to FIG. 4.

The thickness of the surface part of the toner collecting roller 25 is preferably 1 mm or less, more preferably 0.5 mm or less. If the thickness falls within the range, cracking or interfacial peeling off at the insulating layer can be prevented which is due to the difference in expansion coefficient between the cored bar and the surface part by an environmental change or change in diameter due to moisture.

A collecting blade 26 is a member having both function as a flicker of the collecting roller 24 and a function of charge injection to compensate the lowering of the surface potential at the toner collecting roller 24.

The latter function will be explained later with reference to FIG. 6.

To achieve the above two functions, the collecting blade 26 is made from an elastomer such as polyurethane, silicone, and nitrile rubber, and is formed so as to secure the close contact with the toner collecting roller 24. It is also required that a volume resistivity of the blade itself be $10^{12}\Omega\cdot$cm or less to ensure the charge injection to the toner collecting roller 24.

To obtain conductivity, carbon, metallic filler, an ion conductive agent, or the like is added to the elastomer.

The cleaning according to the above mentioned cleaning device is an electrostatic cleaning for the remaining toner, which will be explained in more detail with reference to FIGS. 4 and 5. In addition thereto, the reason for setting a bias voltage between the secondary brush roller 25 and the toner collecting roller 24, and the reason for setting a bias voltage between the toner collecting roller 24 and the collecting blade 26 will be explained.

Figure 4:
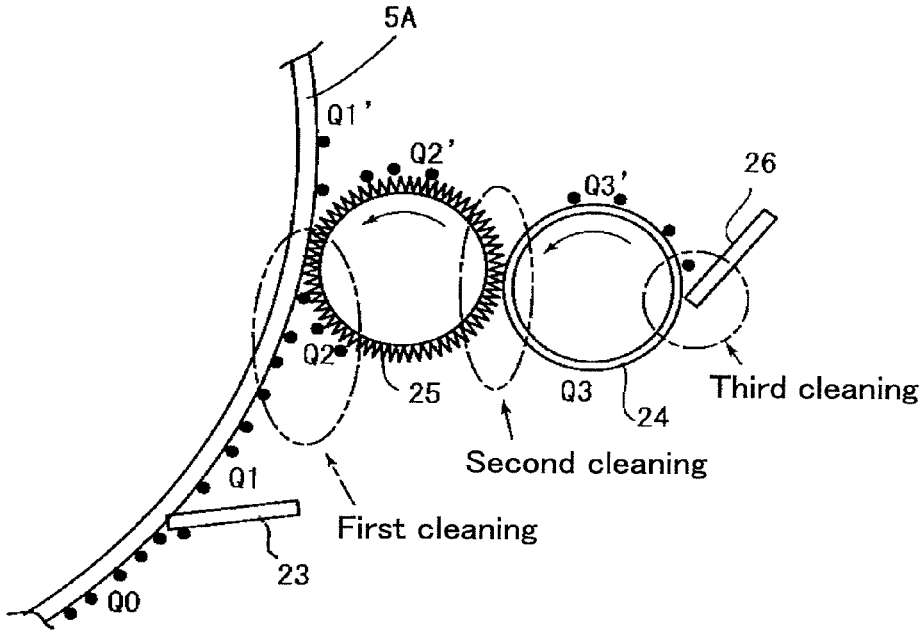
FIG. 4 is a schematic diagram for explaining a principle of an electrostatic cleaning.
Figure 5:
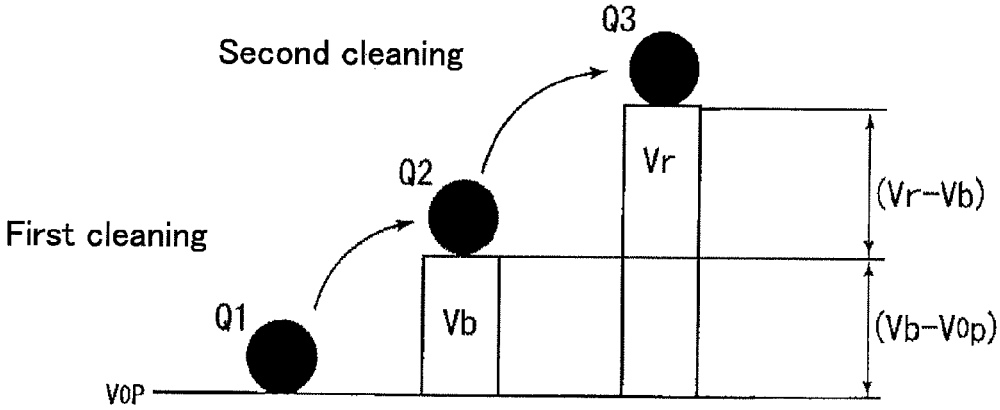
FIG. 5 is a diagram for explaining a state in which a bias voltage needed for the remaining toner to transfer is applied.

With reference to FIG. 4, in a transfer step using a transfer bias, if a positive transfer bias voltage, for example, is applied to a toner with negative polarity after a development, all the toner may be transferred onto the recording medium such as a recording paper or an intermediate transfer belt. However, at a position where a transfer bias is applied, since an electric field is formed at a narrow gap, separating discharge occurs, resulting in that both positive and negative polarities coexists in the remaining toner (represented by Q0 in FIG. 4) after the transfer.

Thus the polarity control member 23 is needed to unify the polarity of the toner (Q0 in FIG. 4 means an amount of electric charge) having positive or negative polarity to either positive or negative polarity.

An electrostatic force larger than the electrostatic force by which the toner is attached to the intermediate transfer belt 5A as an example of an image bearing member is applied to the secondary brush roller 25 so as to transfer the remaining toner (Q1 in FIG. 4 is an amount of electric charge of the toner) onto the brush side. This step is the first cleaning step shown in FIG. 4.

The remaining toner (Q2 in FIG. 4 is an amount of electric charge of the toner) adhering to the secondary brush roller 25 is electrostatically transferred onto the toner collecting roller 24 under the bias voltage applied to the toner collecting roller 24. This step is the second cleaning shown in FIG. 4.

The remaining toner (Q3 in FIG. 4 is an amount of electric charge of the toner) transferred onto the toner collecting roller 24 is to be swept by the collecting blade 26. This step is the third cleaning shown in FIG. 4.

The difference in potential set for the transfer of the remaining toner in each of the first and second cleaning steps as described above is shown in FIG. 5 illustrating the toner transfer model. Given that the surface potential of the image bearing member such as the intermediate transfer belt 5A is V0$p$, the surface potential of the secondary brush roller 25 is Vb, and the surface potential of the toner collecting roller 26 is Vr, an electrostatic force is represented by the product of the difference in potential [(Vb·V0$p$) or (Vr−Vb)] and [Q0, Q1 or Q2] in each cleaning step, and depending on the inequality relation, the remaining toner is transferred and subjected to the third cleaning.

The remaining toner after the transfer can be collected in principle in the above described steps. However, in the case where the intermediate transfer belt 5A is used as an image bearing member which is the object of the cleaning, a sufficient cleaning effect cannot always be obtained even when the above described bias voltage is applied.

As mentioned earlier, since the intermediate transfer belt 5A is to be in contact with a recording medium such as paper, paper dusts due to the paper fibers may be attached thereto. If such paper dusts are drawn into the gap between the polarity control member 23 and the intermediate transfer belt 5A, some remaining toner may easily pass through the tip of the polarity control member 23, and charge injection enough for unifying the polarity of the remaining toner cannot be performed.

In the present embodiment, the primary brush roller 21 is disposed upstream of the polarity control member 23 in the travel direction of the image bearing member 5A, and by the primary brush roller 21, paper dusts and part of or a whole of a large quantity of the toner that remains as the patch image can be swept.

The primary brush roller 21 not only sweeps the remaining toner, but also supplements the charge injection, as mentioned earlier, to the polarity control member 23 when a bias voltage having the same polarity as the polarity of the polarity control member 23 is applied thereto. Accordingly, with the polarity control member 23, the sweeping of the remaining toner becomes easier and the polarity unification becomes more efficient.

If a voltage is applied only to the shaft of the roller, the surface potential of the toner collecting roller 24 and the secondary brush roller 25 is lowered when the surface of the brush comes in contact with the remaining toner. If the surface potential lowers, the toner cannot be transferred and is accumulated on the brush as the sufficient electric potential enough to transfer the toner cannot be maintained, covering the peripheral surface of the brush roller (roll formation). To avoid such a problem, it is necessary to apply a voltage which is about 200 V to about 500 V higher in potential than a voltage to be applied to the shaft as a surface potential of the secondary brush roller 25. Likewise, in the toner collecting roller 24, it is necessary to apply a voltage which is about 400 V to about 800 V higher in potential than a voltage to be applied to the shaft.

When a voltage higher than the voltage to be applied to the shaft is applied onto the roller surface, discharge deterioration due to the applied voltage on the surface occurs as damage, in addition to the deterioration by the blade in contact with the roller. Such damages make the roller surface rough, reduces friction coefficient on the rough surface and reduces frictional force, resulting in the increase of pass-through of the remaining toner from the blade tip.

In FIG. 4, the remaining toner represented by Q3' passes through the collecting blade 26, the remaining toner represented by Q2' is reattached and transferred onto the intermediate transfer belt 5A with which the secondary brush roller 25 is in contact, resulting in smearing on the belt, causing a background smear on the recording medium or the like (attaching of the toner represented by Q1' in FIG. 4, for convenience).

Therefore, it is necessary for the toner collecting roller 24 to be made of an insulating material which is hard to discharge, to properly maintain a surface roughness (i.e. surface smoothness), to be less damaged by the discharge or abrasion, and to have the above described structure.

The collecting blade 26 being in contact with the toner collecting roller 24 has a function of charge injection into the toner collecting roller 24. The reason for this is described as follows.

On the toner collecting roller 24 having the remaining toner transfer thereto from the secondary brush roller 25 by electrostatic force, electric charge is saturated due to the attachment of the remaining toner and thereby the surface potential lowers.

The collecting blade 26 injects charge into the toner collecting roller 24 to compensate for reduction of the potential difference between the secondary brush roller 25 and the collecting roller 24.

Figure 6:
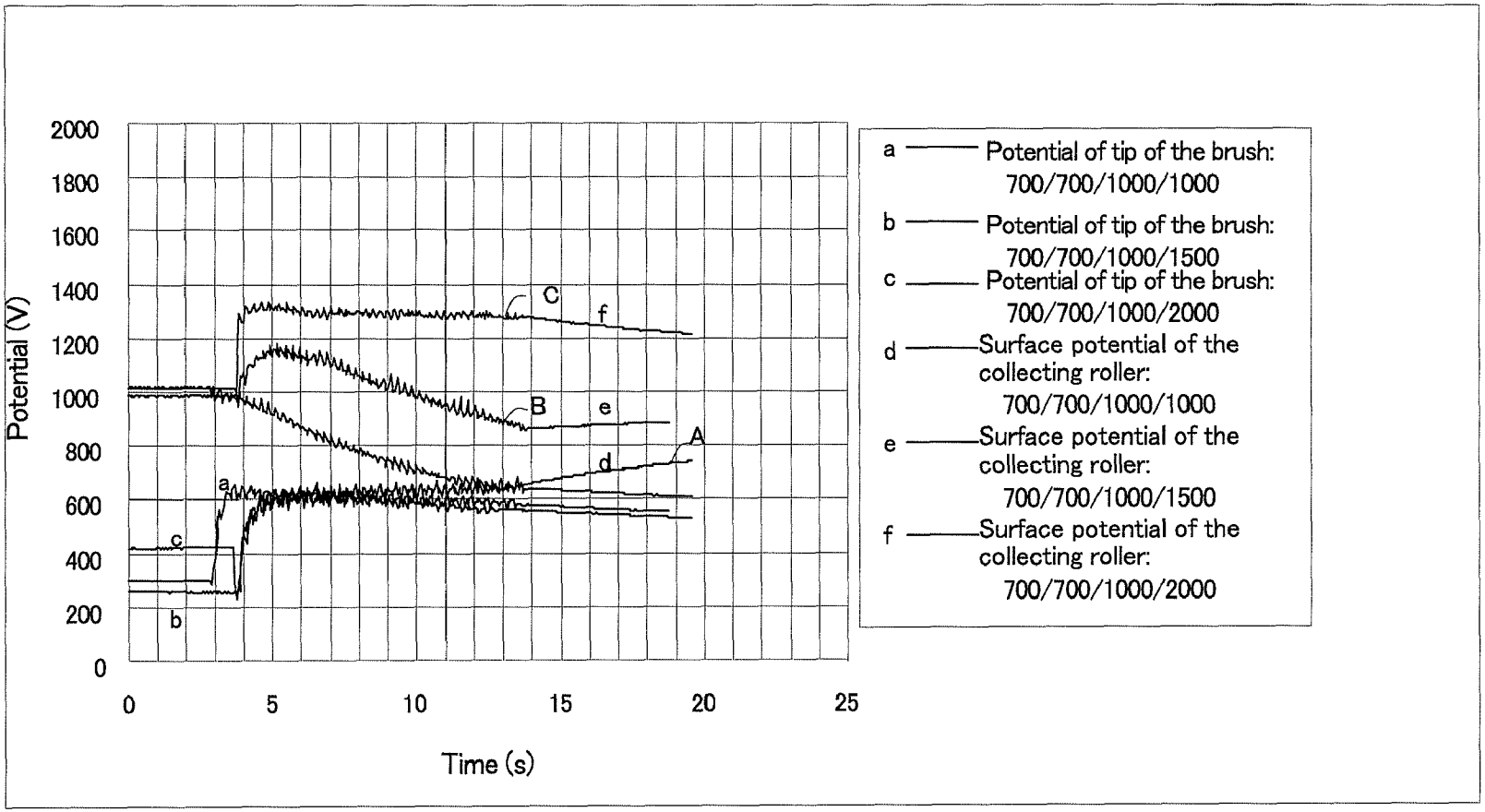
FIG. 6 is a diagram for explaining time-course changes in surface potential of the toner collecting roller and the secondary brush roller in the case where the applied voltage onto the secondary brush roller, toner collecting roller and collecting blade is successively changed.

FIG. 6 shows the change in electric potential on the surface of the toner collecting roller due to the application of a surface voltage to the toner collecting roller 24.

More specifically, FIG. 6 shows the effect of maintaining the difference of potential between the tip of the brush and the collecting roller by showing changes with time of the surface potential at the toner collecting roller 24 and the secondary brush roller (tip of the brush: a copper plate) 25 when the applied voltage to the secondary brush roller 25 is 700 V, the applied voltage to the toner collecting roller 24 is 1,000 V, the applied voltage to the collecting blade (conductive blade) 26 is changed successively to 1,000 V (A), 1,500 V (B), and 2,000 V (C).

As is clear from the results in FIG. 6, if the applied voltage is low, the surface potential on the toner collecting roller 24 approaches with time to the surface potential of the secondary brush roller 25. As a result, the difference in potential between the secondary brush roller 25 and the toner collecting roller 24 becomes too small to transfer the toner.

Accordingly, the collecting blade 26 is connected to the power source 104 capable of applying thereto a voltage having the same polarity to compensate for the voltage depression at the toner collecting roller 24.

Example

Hereinafter, Examples of the present invention is explained. Notably, the present invention is not limited to Examples shown below.

The configuration of the cleaning device for use in Examples is shown in FIG. 3. Properties of each member are as follows.

The material for the primary brush roller 21 is polyester BR1, and the direction of hairs is upright, the resistivity is $10^5\Omega\cdot$cm, the thickness is 320 T/48, the density is 70,000±10,000 hairs/inch$^2$, and the outer diameter is ϕ13 mm.

The stiffness index of the brush ranges from 16 to 59, and the experiments were performed using the brushes having 3 types of stiffness indexes. The stiffness index is a specific value obtained by the experiment and calculation by Toei-sangyo Co., Ltd. If this stiffness index is large, the hairs are stiff. As a bias-applying voltage V1, a DC voltage in the range of −300 V to −600 V is set.

The polarity control member 23 is made of polyurethane rubber having thickness of 1.6 mm to 2.4 mm, has a free length of 7 mm, a thrust amount of 0.5 mm, and volume resistivity of $10^6\Omega\cdot$cm. As an applied voltage V2, a DC voltage of −500 V is set.

The secondary brush roller 25 is made of PET, B-TCF, and the hairs thereof are inclined toward the direction of the rotation. The resistivity of the brush is $10^7\Omega\cdot$cm, the thickness of the hair is 320 T/48, the density of the brush is 115,200±580 hairs/inch$^2$, and the outer diameter is ϕ14 mm. As a bias voltage V3, a DC voltage of +300 V is applied.

The toner collecting roller 24 is formed by covering a core metal of stainless or commonly used steel (S45C, SUM21) having outer diameter of ϕ14 mm with 0.1 mm-thick PVDF tube, and further the surface is coated with a hybrid hard coating agent by a dipping coating. The obtained film has a thickness of 10 μm, a pencil hardness of 8 H, and a surface roughness Ra of 0.03 μm. Other conditions are as follows: the applied voltage V4 is +600 V; the collecting blade 26 has a thickness of 2 mm to 2.8 mm and made of polyurethane rubber; a free length is 7 mm; a thrust amount is 1 mm; a volume resistivity is $10^8\Omega\cdot$cm; and the applied voltage V5 is +1,000 V.

The intermediate transfer belt 5A used as an image bearing member has a linear velocity of 200 mm/s, and the brush has a uniform velocity. The brush rotates in the same direction as the rotation direction of the intermediate transfer belt 5A, so that, at the contact point, the brush moves in a counter direction to the movement of the intermediate transfer belt 5A.

Under the above described conditions, experiments were conducted by varying a bias voltage applied to the primary brush roller 21. If any cleaning failure occurs, the toner remains on the intermediate transfer belt 5A, which causes background smear on the recording medium. The results are shown in Table 1.

Table 1 shows the degree of the resulted background smear (image quality) on the recording paper used as a recording medium, after printing a 5% standard image on 10,000 sheets.

In Table 1, "C" indicates a state in which a longitudinal streak and background smear clearly appear; "B" indicates a state in which a longitudinal streak and background smear slightly appear; and "A" indicates an excellent state which is the same as the initial state.

TABLE 1

| The results of cleaning tests | | | |
|---|---|---|---|
| Applied voltage | Stiffness of brush | | |
| V1 | 16.7 | 39.31 | 58.92 |
| 0 | C | C | C |
| −300 | C | C | B |
| −400 | B | B | A |
| −500 | A | A | A |
| −600 | B | A | B |

The results in Table 1 clearly show that when a voltage V1 is not applied to the primary brush roller 21, a background smear occurs. Before performing the experiments, a cleaning test was carried out in the absence of the primary brush roller 21, with the result that a cleaning failure, occurring of streaks, was observed in an early stage. The good results are obtained in the case where both stiffness of the brush and the applied voltage V1 are high.

It is found from the above results that when the stiffness of the brush of the primary brush roller 21 is somewhat high, paper dusts or foreign matters attached to the belt are removed; and that when a bias voltage is applied to the primary brush roller 21, the charge control efficiency is increased compared to the case where only the blade 23 as a polarity control member is used, and the polarity of the toner entering the secondary brush roller 25 is almost controlled, resulting in a good cleanability.

What is claimed is:

1. A cleaning device for removing a toner remaining on an image bearing member after transfer, comprising:

a polarity control member configured to unify polarities of the remaining toner on the image bearing member, a cleaning member configured to remove the remaining toner having a polarity unified by the polarity control member, a collecting member configured to collect the remaining toner transferred to the cleaning member, a blade configured to remove the remaining toner from the collecting member, and a brush roller configured to sweep the remaining toner on the image bearing member and inject charge, disposed upstream of the polarity control member in the traveling direction of the image bearing member, wherein a hair density of the brush roller disposed upstream of the polarity control member is higher than that of a brush roller used as the cleaning member.

2. The cleaning device according to claim 1, wherein the brush roller disposed upstream of the polarity control member has conductivity and is connected to a bias voltage applying unit.

3. The cleaning device according to claim 2, wherein the brush roller disposed upstream of the polarity control member has a brush containing conductive strings and the conductive strings are exposed from a surface of a brush surface to be in contact with the toner.

4. The cleaning device according to claim 1, wherein the brush roller disposed upstream of the polarity control member and the polarity control member are applied with the same polarity of voltage, and the brush roller disposed upstream of the polarity control member is applied with an equal or lower value of voltage compared to the applied voltage of the polarity control member.

5. The cleaning device according to claim 1, wherein the brush roller used as the cleaning member has a reverse polarity of voltage to a polarity of voltage applied to the brush roller disposed upstream of the polarity control member.

6. The cleaning device according to claim 1, wherein a stiffness of a brush of the brush roller used in the cleaning member is higher than a stiffness of a brush of the brush roller disposed at upstream of the polarity control member.

7. The cleaning device according to claim 1, wherein the remaining toner on the image bearing member has a shape factor SF-1 of 100 to 150 and a toner average particle diameter of 6 μm or less.

8. An image forming apparatus, comprising:

a cleaning device for removing a toner remaining on an image bearing member after transfer, which comprises:

a polarity control member configured to unify polarities of the remaining toner on the image bearing member, a cleaning member configured to remove the remaining toner having a polarity unified by the polarity control member, a collecting member configured to collect the remaining toner transferred to the cleaning member, a blade configured to remove the remaining toner from the collecting member, and a brush roller configured to sweep the remaining toner on the image bearing member and inject charge, disposed upstream of the polarity control member in the traveling direction of the image bearing member, wherein a hair density of the brush roller disposed upstream of the polarity control member is higher than that of a brush roller used as the cleaning member.

9. The image forming apparatus according to claim 8, wherein the cleaning device is configured to clean an intermediate transfer member.

* * * * *